US008561514B2

(12) United States Patent
Head, III et al.

(10) Patent No.: US 8,561,514 B2
(45) Date of Patent: Oct. 22, 2013

(54) BRAIDED CARBON NANOTUBE THREADS AND METHODS OF MANUFACTURING THE SAME

(75) Inventors: Joseph Henry Head, III, Cincinnati, OH (US); Stephen Sester, Fort Thomas, KY (US); Terry W. Purcell, Jr., Dry Ridge, KY (US); Jeramie Lawson, Edgewood, KY (US); Jerome T. Jones, Morning View, KY (US)

(73) Assignee: Atkins & Pearce, Inc., Covington, KY (US)

( * ) Notice: Subject to any disclaimer, the term of this patent is extended or adjusted under 35 U.S.C. 154(b) by 54 days.

(21) Appl. No.: 13/324,298

(22) Filed: Dec. 13, 2011

(65) Prior Publication Data

US 2012/0144984 A1 Jun. 14, 2012

Related U.S. Application Data

(60) Provisional application No. 61/422,853, filed on Dec. 14, 2010.

(51) Int. Cl.
*D04C 1/02* (2006.01)

(52) U.S. Cl.
USPC ..... 87/8

(58) Field of Classification Search
USPC ..... 87/6, 8, 9, 13, 33, 55, 56
See application file for complete search history.

(56) References Cited

U.S. PATENT DOCUMENTS

| | | | | |
|---|---|---|---|---|
| 3,038,367 | A | 6/1962 | Karg et al. | |
| 3,324,757 | A | 6/1967 | Richardson | |
| 3,839,939 | A | 10/1974 | Wily | |
| 5,370,031 | A | 12/1994 | Koyfman et al. | |
| 5,520,084 | A | 5/1996 | Chesterfield et al. | |
| 7,449,631 | B2 | 11/2008 | Lee et al. | |
| 7,459,627 | B2 | 12/2008 | Lee et al. | |
| 7,491,883 | B2 | 2/2009 | Lee et al. | |
| 2004/0254633 | A1 | 12/2004 | Rapaport et al. | |
| 2008/0089830 | A1 | 4/2008 | Smalley et al. | |
| 2008/0170982 | A1 * | 7/2008 | Zhang et al. | 423/447.3 |
| 2008/0251274 | A1 | 10/2008 | Lee et al. | |
| 2009/0282802 | A1 | 11/2009 | Cooper et al. | |
| 2009/0314510 | A1 | 12/2009 | Kukowski et al. | |

FOREIGN PATENT DOCUMENTS

| | | |
|---|---|---|
| GB | 1332501 | 10/1973 |
| GB | 1332591 | 10/1973 |
| WO | WO 2010059832 A1 * | 5/2010 |

OTHER PUBLICATIONS

International Search Report and Written Opinion for PCT/2011/064586 mailed on Jul. 13, 2012.

* cited by examiner

*Primary Examiner* — Shaun R Hurley

(74) *Attorney, Agent, or Firm* — Dinsmore & Shohl LLP

(57) ABSTRACT

A braided carbon nanotube thread includes at least three carbon nanotube filaments braided into a thread. The carbon nanotube filaments include a plurality of carbon nanotubes, each of the carbon nanotubes having a length L. The carbon nanotube filaments are braided such that the carbon nanotube thread has at least 8 intersections per the length L of each carbon nanotube. The carbon nanotube thread has a tensile strength greater than the tensile strength of the constituent carbon nanotube filaments.

24 Claims, 8 Drawing Sheets

BRAIDED CARBON NANOTUBE THREADS AND METHODS OF MANUFACTURING THE SAME

CROSS-REFERENCE TO RELATED APPLICATIONS

This application claims the benefit of U.S. Provisional Patent Application Ser. No. 61/422,853 filed Dec. 14, 2010.

TECHNICAL FIELD

The present disclosure is generally directed to braided thread made from carbon nanotubes and methods and devices for forming the same.

BACKGROUND

Carbon nanotubes (CNTs) are nanomaterials that individually include properties of high modulus, tensile strength, aspect ratio, and electrical and thermal conductivity. Early fabrication of CNT filaments was based on "wet" spinning methods, which require dispersing CNTs in a solution for further spinning processes. The chemical dispersion process generally leads to a low usage of CNTs, and the spun filament usually contains surfactants or polymer molecules which reduce the strength and the thermal and electrical properties of the filament. "Dry" spinning methods are also used to prepare CNT filaments composed of pure CNTs from as-grown super-aligned CNT (SACNT) arrays. More recently, the dry spinning method that directly spins CNT filaments from SACNT arrays has attracted attention because the dry spinning method is simple and controllable to produce continuous CNT filaments.

The dry spinning method is enabled by the van der Waals forces between CNTs that provide a cohesive force that enables the CNTs to readily stick to one another. While the van der Waals forces may be disadvantageous to applications such as composite films where a high degree of dispersion is preferred, the van der Waals forces can prove useful in the preparation of CNT filaments, threads, and ribbons. However, while the van der Waals forces are relatively strong in an orientation that adheres the CNTs to one another (i.e., in the thickness of the filament) the van der Waals forces are comparatively weak in an orientation of CNT alignment (i.e., along the length of the filament). Therefore, filaments made from CNTs typically exhibit tensile strength that is orders of magnitude less than the tensile strength of the individual CNTs. Accordingly, improvements in the strength of thread made from CNTs is desired.

SUMMARY

According to one embodiment, a braided carbon nanotube thread includes at least three carbon nanotube filaments braided into a thread. The carbon nanotube filaments include a plurality of carbon nanotubes, each of the carbon nanotubes having a length L. The carbon nanotube filaments are braided such that the carbon nanotube thread has at least 8 intersections per the length L of each carbon nanotube.

In another embodiment, a braided carbon nanotube thread includes at least three carbon nanotube filaments braided into a thread. The carbon nanotube filaments include a plurality of carbon nanotubes each having a length of at least 220 microns and a diameter of at least 10 nanometers. The carbon nanotube filaments are braided with at least 20 picks per millimeter of carbon nanotube thread.

In another embodiment, a low-tension carrier for supplying a carbon nanotube filament from a bobbin to a braiding machine includes a base member having a braiding machine interface, a spindle coupled to the base member and extending away from the braiding machine interface, and a tensioner guide post coupled to the base member and extending away from the braiding machine interface. The bobbin is mounted on the spindle for rotation about the spindle and the bobbin includes a pay-out spool and an indexing interface. The low-tension carrier further includes a pawl coupled to the base member and having a plurality of positions including an engaged position wherein the pawl is biased to resist rotation of the indexing interface of the bobbin, and a disengaged position wherein the pawl is biased to allow rotation of the indexing interface of the bobbin. The low-tension carrier also includes a tensioner assembly comprising a tensioner bracket and a guide roller. The tensioner assembly having a plurality of positions as the tensioner bracket translates along the tensioner guide post, the positions including a non-contacting position wherein the tensioner bracket is spaced apart from the pawl thereby allowing the pawl to be positioned in the engaged position, and a contacting position wherein the tensioner bracket is in contact with the pawl thereby placing the pawl in the disengaged position, and the tensioner assembly applies an actuation tension to the carbon nanotube filament.

In yet another embodiment, a method of producing a braided carbon nanotube thread includes providing an array of aligned carbon nanotubes, drawing a plurality of carbon nanotubes from the array thereby forming a carbon nanotube filament formed from the plurality of carbon nanotubes, where each of the carbon nanotubes has a length L. The method further includes twisting the plurality of drawn carbon nanotubes of the carbon nanotube filament about one another, winding the carbon nanotube filament onto at least three bobbins, installing the bobbins into a braiding machine, and braiding the carbon nanotube filaments from the bobbins into a braided carbon nanotube thread, wherein the braided carbon nanotube thread has at least 8 picks per the length L.

These and additional objects and advantages provided by the embodiments of the present disclosure will be more fully understood in view of the following detailed description, in conjunction with the drawings.

BRIEF DESCRIPTION OF THE DRAWINGS

The following detailed description of specific embodiments described herein can be best understood when read in conjunction with the drawings enclosed herewith.

Figure 1:
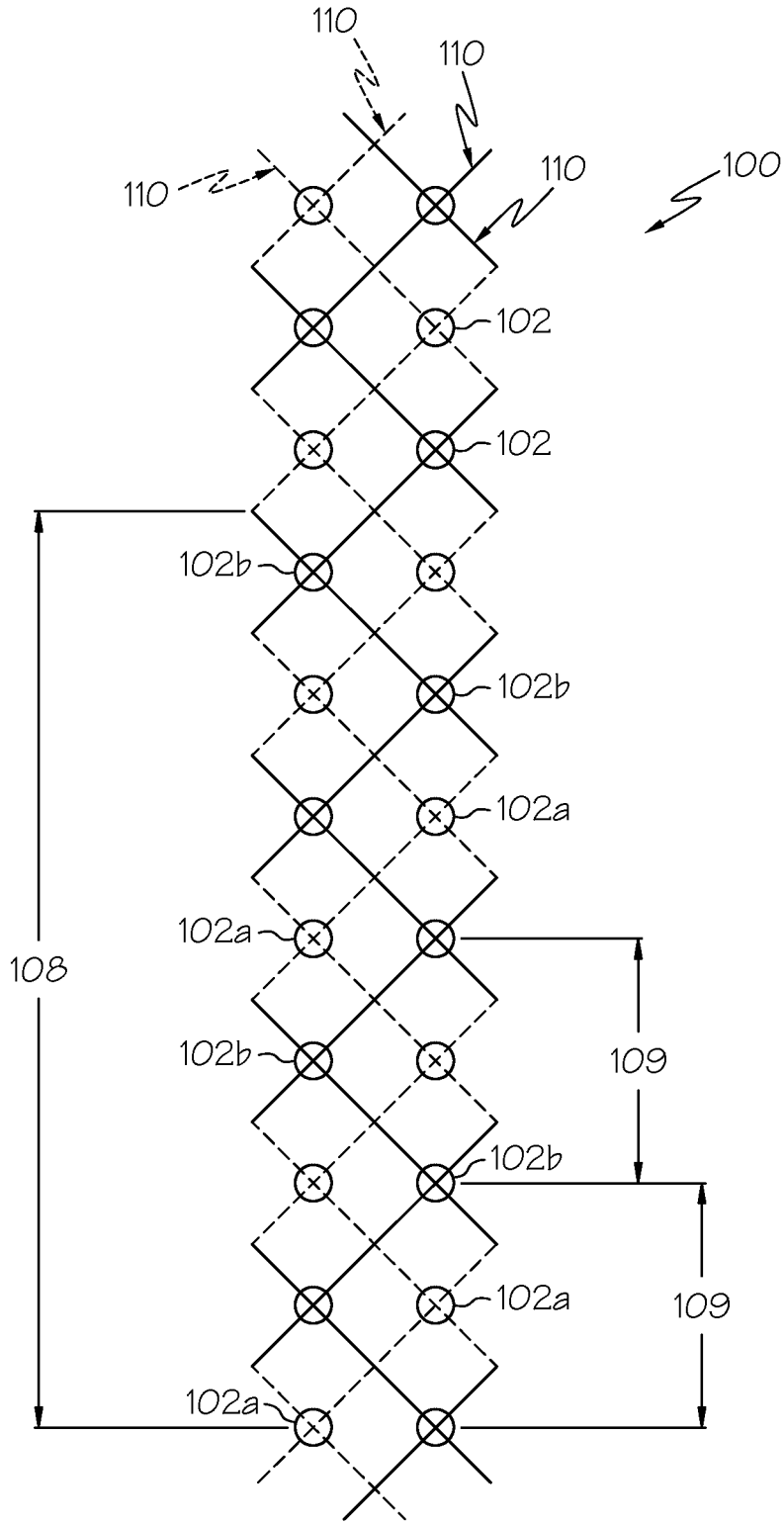
FIG. 1 is a schematic representation of a thread made from CNTs according to one or more embodiments shown and described herein.

The embodiments set forth in the drawings are illustrative in nature and not intended to be limiting of the disclosure defined by the claims. Moreover, individual features of the drawings and disclosure will be more fully apparent and understood in view of the detailed description.

DETAILED DESCRIPTION

Embodiments of the present disclosure are directed to threads made of braided CNT filaments. The threads exhibit tensile strength that is greater than the tensile strength of the constituent CNT filaments. The CNT filaments are braided into a thread such that the filaments cross over one another at "pick" locations. By braiding the CNT filaments with an appropriate number of "picks" per length of the CNTs, the tensile strength of the resulting CNT thread can be enhanced to be greater than the tensile strength of the CNT filaments.

Referring in detail to FIG. 1, a schematic representation of a thread 100 manufactured from CNT filaments 110 is depicted. The thread 100 depicted in FIG. 1 includes four CNT filaments 110 that are braided in a 1-over, 1-under pattern. The portions of the CNT filaments 110 positioned on the front-side of the thread 100 are shown as solid lines, while the portions of the CNT filaments 110 positioned on the back-side of the thread 100 are shown as dashed lines. The CNT filaments 110 are braided about one another to form the thread 100. Locations where the opposing CNT filaments 110 overlap one another are defined as intersections 102 including front-side intersections 102*b* and back-side intersections 102*a*. A pick 109 is defined as the distance from an initial intersection 102 of opposing CNT filaments 110 to a subsequent intersection 102 along the length of the thread 100. The frequency of picks 109 per unit length 108 of the thread 100 determines the density of the braid pattern of the thread 100. Therefore, the number of intersections 102 per CNT 106 is dependent on the length of CNT 106, the number of CNT filaments 110 braided into the thread 100, and the frequency of picks 109 per unit length 108 of the thread 100.

Figure 2:
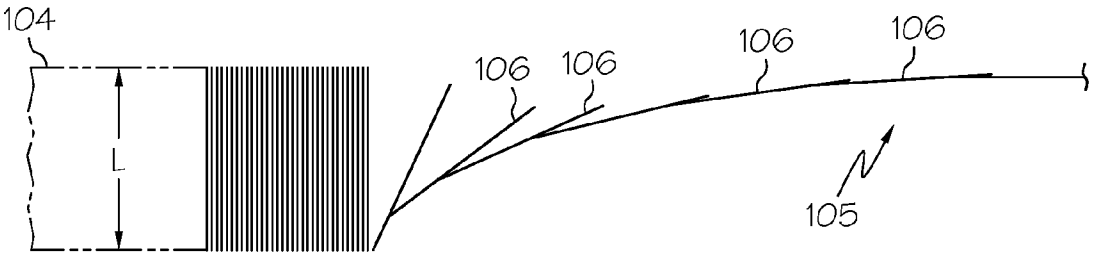
FIG. 2 is a schematic representation of a dry spinning method of forming CNT filament according to one or more embodiments shown and described herein.
Figure 3:
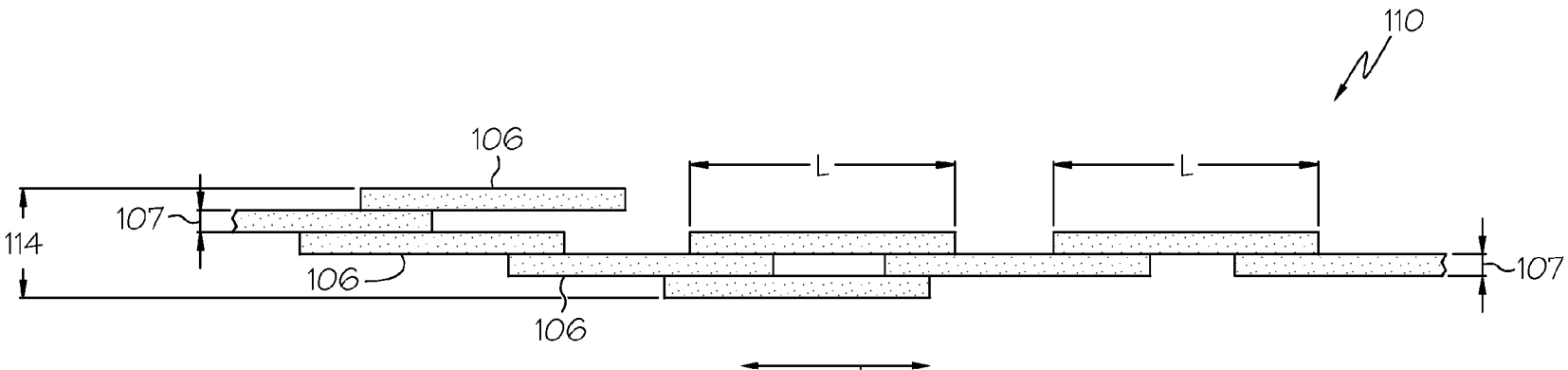
FIG. 3 is a schematic representation of a CNT filament according to one or more embodiments shown and described herein.

Referring to FIGS. 2 and 3, the dry spinning method of producing CNT filaments 110 is depicted. CNTs 106 are grown in an array 104, where the axes of the CNTs 106 are aligned and generally parallel with one another. The CNTs have a length L and a characteristic diameter 107. CNTs 106 are pulled off of the array 104 such that the CNTs are approximately axially aligned. As the CNTs 106 are pulled away from the array 104, attraction forces between proximal CNTs 106 join the CNTs 106 together, allowing a continuous ribbon 105 of CNTs to be formed.

It has been determined that to further increase the strength of the ribbon 105 of CNTs 106, techniques to "densify" (i.e., increase the density) the ribbon 105 may be used. Such techniques include, but are not limited to, twisting, tensioning, or treatment of spun and/or twisted ribbon 105 with solvents to physically remove the interstitial spaces between the individual CNTs 106. By employing such techniques, the tensile strength of the spun CNT filaments 110 formed from the ribbon 105 can be consistently in the range of 0.4 to 1.0 GPa.

CNT filaments 110 prepared according to this method have CNTs 106 that are generally aligned in the axial direction 112 of the CNT filament 110. When the CNTs 106 are aligned in the axial direction 112, the van der Waals forces in the lateral direction 114 of the CNT filament 110 are strong and the bundle integrity of the CNT filament 110 is good. However, even when the CNTs 106 are aligned in the axial direction 112, there can still be gaps or open spaces between individual CNTs 106. The gaps or spaces may reduce the surface area in contact between individual CNTs 106, thereby reducing the van der Waals forces. The gaps or spaces may decrease the tensile strength of the CNT filament 110 by allowing the individual CNTs 106 to slide past one another when an external force is applied in an axial direction 112 of the CNT filament 110. As a result, producing CNT filament 110 having tensile strengths greater than about 1 GPa has been difficult using conventional methods, in spite of the individual CNTs 106 having reported tensile strengths as great as 100 GPa.

Figure 4:
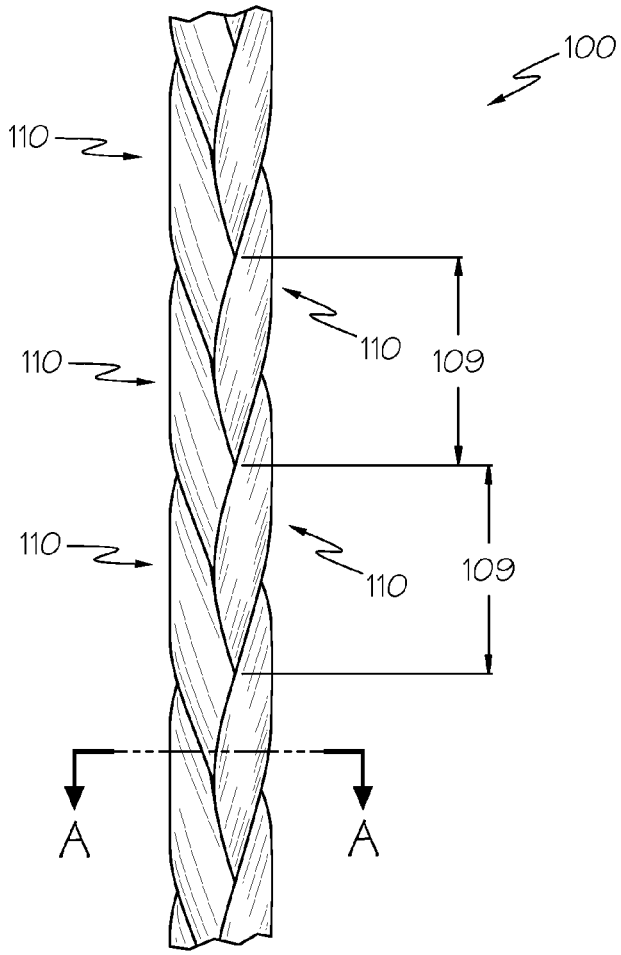
FIG. 4 is a schematic representation of a thread made from CNTs according to one or more embodiments shown and described herein.
Figure 5:
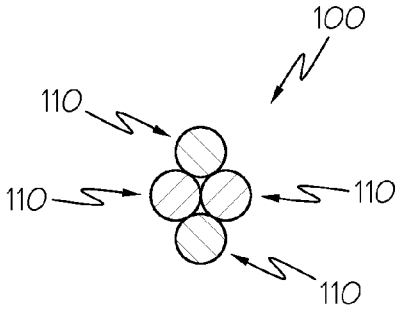
FIG. 5 is a cross-sectional view of a thread made from CNTs along line A-A of FIG. 4.

Referring now to FIG. 4, the CNT filaments 110 can be braided into a thread 100. As illustrated in FIG. 4 and shown in greater detail in FIG. 5, the thread 100 includes four CNT filaments 110 that are braided in a square braid. The thread 100 includes at least three CNT filaments 110 in order to create picks 109 in the thread 100. However, the number of CNT filaments 110 that are braided together to form the thread 100 can vary based on the requirements of a particular application.

Figure 6:
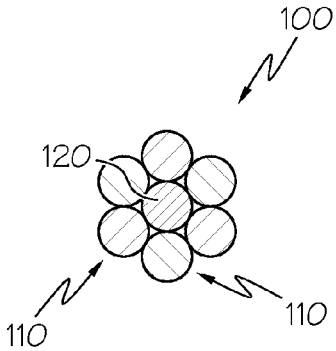
FIG. 6 is a cross-sectional view of a thread made from CNTs along line A-A of FIG. 4.

Referring now to FIG. 6, in some embodiments the thread 100 may include a core section 120 about which the CNT filaments 110 are braided. The core section 120 maintains the shape of the thread 100 during the braiding process. The core section 120 may provide additional structure to the thread 100. As depicted in FIG. 6, the core section 120 is surrounded by six CNT filaments 110. However, it should be understood that the number of CNT filaments 110 incorporated into the thread 100 may vary based on the requirements of a particular application. In one embodiment, 36 separate CNT filaments 110 can be braided around a core section 120 to produce the thread 100. In embodiments described herein, the thread 110 may include a quantity of CNT filaments 110 in a range from about 3 CNT filaments 110 to about 200 CNT filaments 110.

While it has been determined that both monofilament and multifilament fibers typically exhibit maximum strength when the fibers are linearly aligned, braiding of CNT filaments 110 can increase the strength of the resulting thread 100. In one example, manufacturing processes (e.g., weaving, braiding, twisting, and knitting) that convert raw fibers into useable articles often contort these monofilament and multifilament fibers away from the preferred linear alignment, inducing angles and twists which generally detract from the inherent tensile properties of the fiber, as moving the fibers away from a linear orientation prevents application of a force along the axis of the fiber. However, in the case of a CNT filament 110 composed of CNTs 106, braiding of multiple CNT filaments 110 can result in a thread 100 having an increased tensile strength over the constituent CNT filaments 110 in spite of the non-linear path that the CNT filaments 110 follow.

Without being bound by theory, it is believed that mechanical locking of the individual CNTs 106 by braiding can result in increased strength in the thread 100. Referring again to FIG. 1, in some embodiments, the CNT filaments 110 are braided such that the individual CNTs 106 cross-over one another at a frequency from about three intersections 102 per CNT 106 to about 40 intersections 102 per CNT. In some embodiments, the CNT filaments 110 can be braided such that the individual CNTs 106 cross-over one another at a frequency from about 8 intersections 102 per CNT 106 to about 15 intersections 102 per CNT 106. In such embodiments, the intersections 102 have the effect of "trapping" the individual CNTs 106 in the braided thread 100 structure. When a tensile force is applied to the thread 100 along the length of the thread 100, the trapping will lock the individual CNTs 106 to one another, which provides a strength greater than the van der Waals forces of conventional CNT filaments.

In some embodiments, the frequency of intersections 102 per CNT 106 may be constrained by the diameter of the CNT filaments 110 being braided. In the embodiments schematically depicted in FIG. 1, the unit length 108 of a CNT 106 in a twisted CNT filament 110 is about 1000 microns (1 millimeter). The pick 109 frequency per unit length 108 of the CNT filament 110 is about 4 picks per millimeter or more in order to produce a thread 100 having an intersection frequency of about 10 intersections per individual CNT 106. It is believed that when individual CNTs 106 are braided to have about 10 intersections or more per CNT 106 and the thread 100 is placed under tension, the tensile limit of the thread 100 is more likely due to breakage of the CNT 106 rather than exceeding the van der Waals forces and separating the CNTs 106. In this regard, the overall tensile strength of the braided thread 100 is governed by the strength of the individual CNTs 106. Manufacturing the thread 100 to break at the individual CNTs 106 when a tensile load is applied to the thread 100 increases the tensile strength of the thread 100 over the tensile strength of the constituent CNT filaments 110. In some embodiments, the tensile strength of the thread 100 may exceed about 5 GPa, while the tensile strength of the individual CNT filaments 110 is about 1 GPa. In some embodiments, the tensile strength of the thread 100 may exceed about 10 GPa, while the tensile strength of the individual CNT filaments 110 is about 1 GPa.

In embodiments described herein, the CNTs 106 may have a characteristic diameter 107 in a range from about 1 nanometers to about 50 nanometers. In some embodiments, the CNTs 106 may have a characteristic diameter in a range from about 1 nanometers to about 20 nanometers. In embodiments described herein, the CNTs 106 may have a length L in a range from about 100 microns to about 25,000 microns. In some embodiments, the CNTs 106 may have a ratio of length L to characteristic diameter in a range from about 20 to about 20,000.

In embodiments described herein, the CNT filaments 110 may have an average diameter greater than or equal to about 10 microns. In some embodiments, the CNT filaments 110 have an average diameter in a range from about 10 microns to about 500 microns. For example, in some embodiments, the CNT filaments 110 may be in a range from about 10 microns to about 50 microns.

As discussed hereinabove, the CNT filaments 110 are braided into a thread 100. In embodiments described herein, the thread 100 may be made from a number of CNT filaments 110 in a range from about 3 to about 200. In some embodiments, the thread 100 may have a diameter in a range from about 20 microns to about 1500 microns. For example, in one embodiment, a thread 100 having 4 CNT filaments 110 may have a diameter greater than or equal to 20 microns, and may be in a range from about 20 microns to about 400 microns. In embodiments described herein, the CNT filaments 110 may be braided such that the thread 100 has a pick frequency in a range from about 4 picks per millimeter to about 50 picks per millimeter. In some embodiments, the thread 100 may have a pick frequency in a range from about 10 picks per millimeter to about 20 picks per millimeter.

In embodiments described herein, the thread 100 is produced such that the individual CNTs 106 may be intersected with one another in a range from about 2 intersections per CNT length to about 1000 intersections per CNT length. In some embodiments, the individual CNTs 106 may be intersected with one another in a range from about 5 per CNT length to about 400 intersections per CNT length.

In embodiments described herein, thread 100 having these characteristics may have a tensile strength in a range from about 0.5 GPa to about 20 GPa. In some embodiments, the thread 100 may have a tensile strength from about 1 GPa to about 15 GPa.

Figure 7:
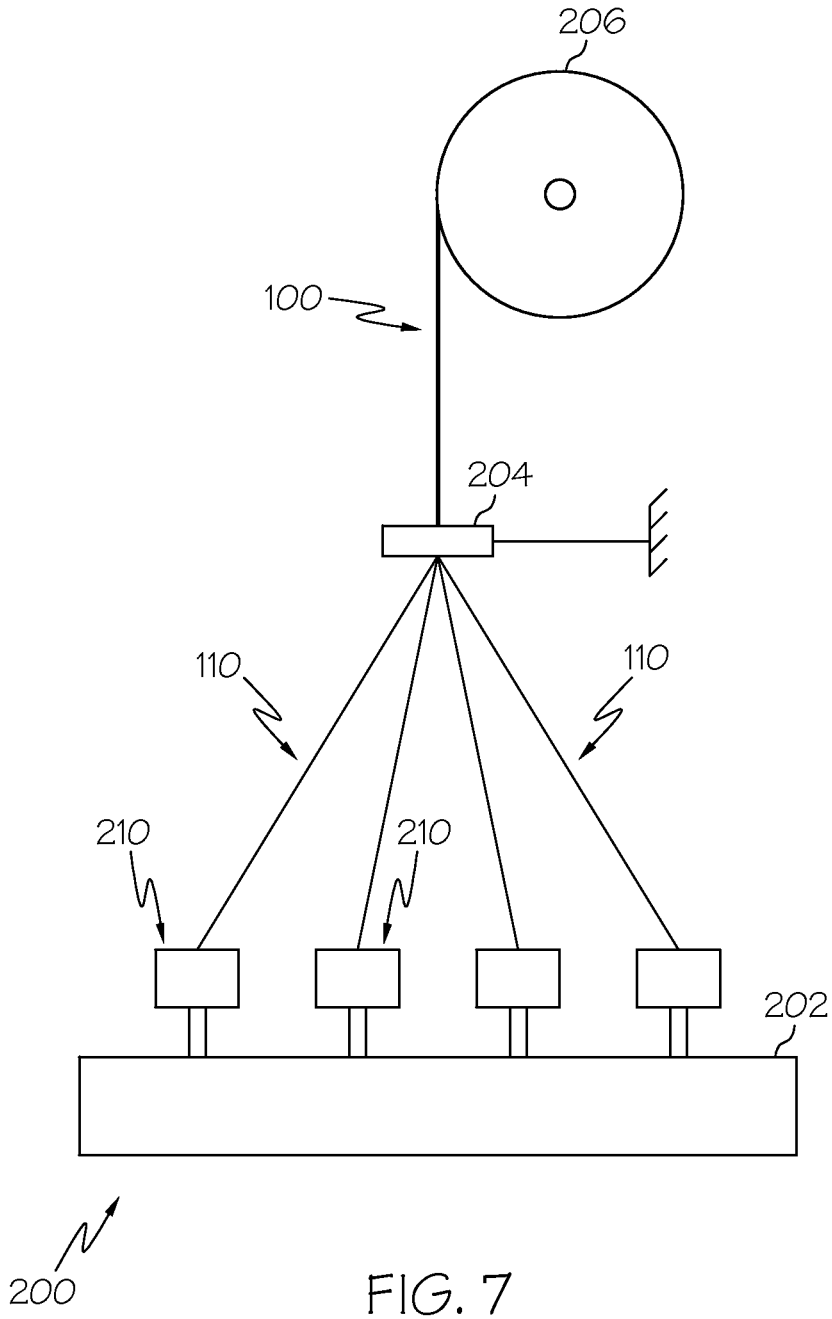
FIG. 7 is a side view of a braiding machine for manufacturing thread made from CNTs according to one or more embodiments shown and described herein.
Figure 8:
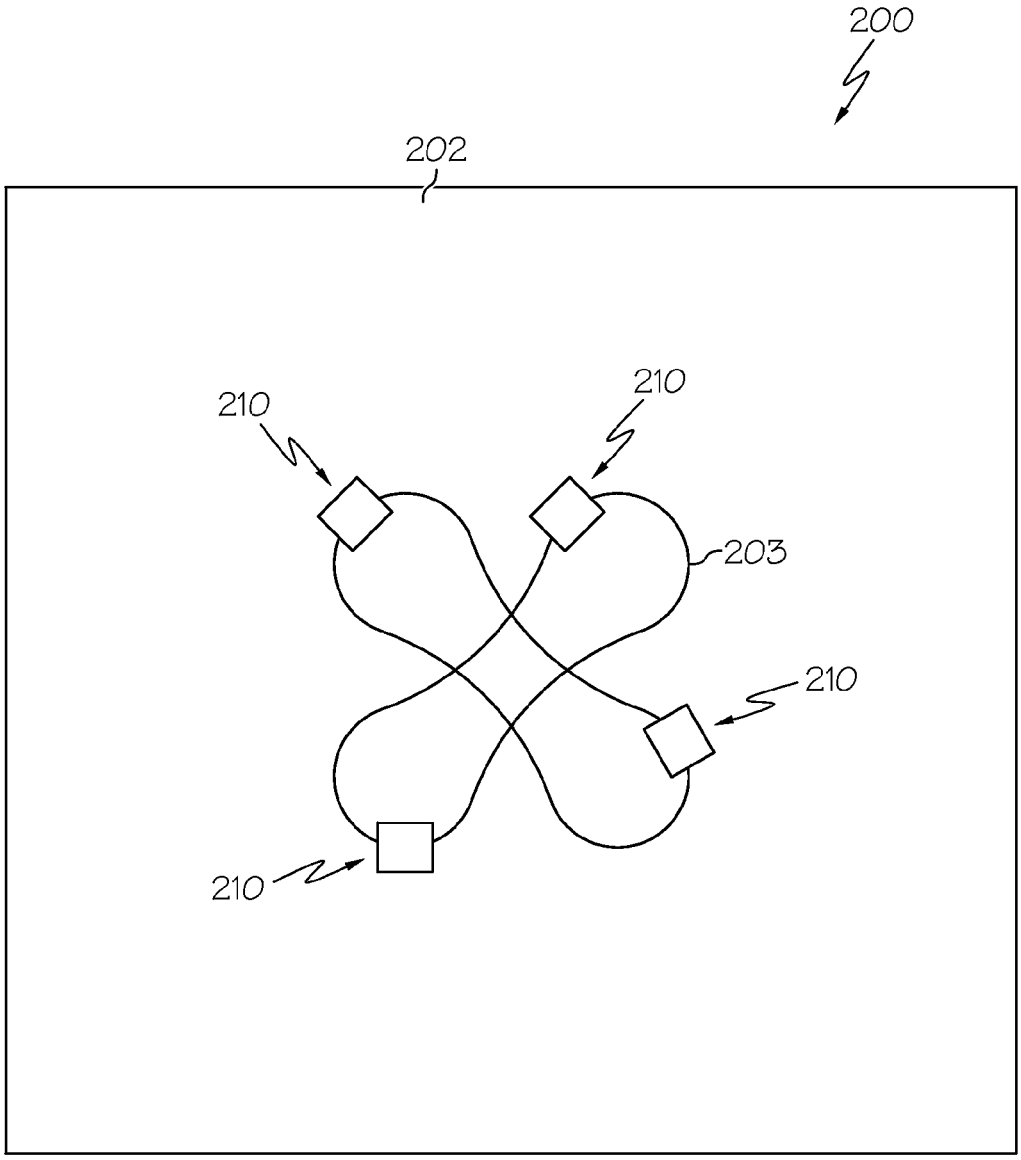
FIG. 8 is a top view of a braiding machine for manufacturing thread made from CNTs according to one or more embodiments shown and described herein.

Referring to FIGS. 7-8, thread 100 made from braided CNT filaments 110 may be manufactured using conventional braiding machines 200 where the CNT filament 110 is wound onto spools and placed in carriers 210. For example, a maypole braider, which is commercially available from a variety of manufacturers including Wardwell Braiding of Central Falls, R.I., can be used to produce a braided thread 100 from CNT filaments 110 having a diameter of about 0.5 millimeter. Such a braiding machine 200 and CNT filaments 110 can be used to produce a braided thread 100 having from about 0.1 to about 2 picks per millimeter.

The braiding machine 200 may include an embedded track 203 in the base portion 202. The carriers 210 of the braiding machine 200 traverse along the embedded track 203, paying out CNT filament 110 as the carriers 210 translate relative to the braid point 204. The CNT filaments 110 are braided into the thread 100 at the braid point 204, whereupon they are collected on a collection roll 206. The path that the carriers 210 follow along the embedded track 203 determines the pattern in which the CNT filaments 110 are braided to form the thread 100.

Typically, commercially available braiding machines 200 include carriers 210 having spring-loaded tensioner assemblies. The spring-loaded tensioner assemblies maintain tension on large gauge CNT filament 110 over a large range of motion of the carriers 210 as the carriers translate along the embedded track 203. For conventional braiding machines, a feed length of the CNT filament 110 measured along the CNT filament 110 from the carrier 210 to the braid point 204 varies as the carrier 210 traverses along the embedded track 203. As an alternative to a conventional braiding machine 200, a braiding machine may incorporate a non-planar baseplate (not shown), for example a braiding machine where the embedded track 203 is positioned on a concave spherical surface. As the carriers 210 follow the embedded track 203 in the non-planar baseplate, the feed length of the CNT filament 110 is approximately the same at every point along the embedded track 203. By reducing the variation in the feed length of the CNT filament 110, tensioner assemblies that maintain consistent tension in the CNT filaments 110 may be eliminated, reducing the tension in the CNT filament 110. The reduction in tension may be beneficial to reduce abrasion caused by the braiding process on the CNT filaments 110, and may allow for lower-strength CNT filament 110 to be braided into thread 100.

In another alternative, for embodiments of the CNT filament 110 having a small diameter, the spring-loaded tensioner assemblies may apply a tension force that exceeds the tensile limit of the CNT filament 110. As the thickness of the CNT filament 110 decreases, the breaking load of the CNT filament 110 decreases. To continue braiding the CNT filaments 110 into a thread 100 using a braiding machine, the tension that is maintained on the CNT filament 110 as the low-tension carriers 210 translate along the embedded track 203 may be reduced to prevent tensile overload of the CNT filament 110. Accordingly, low-tension carriers 210 for paying out small diameter CNT filament 110 are required.

Figure 9:
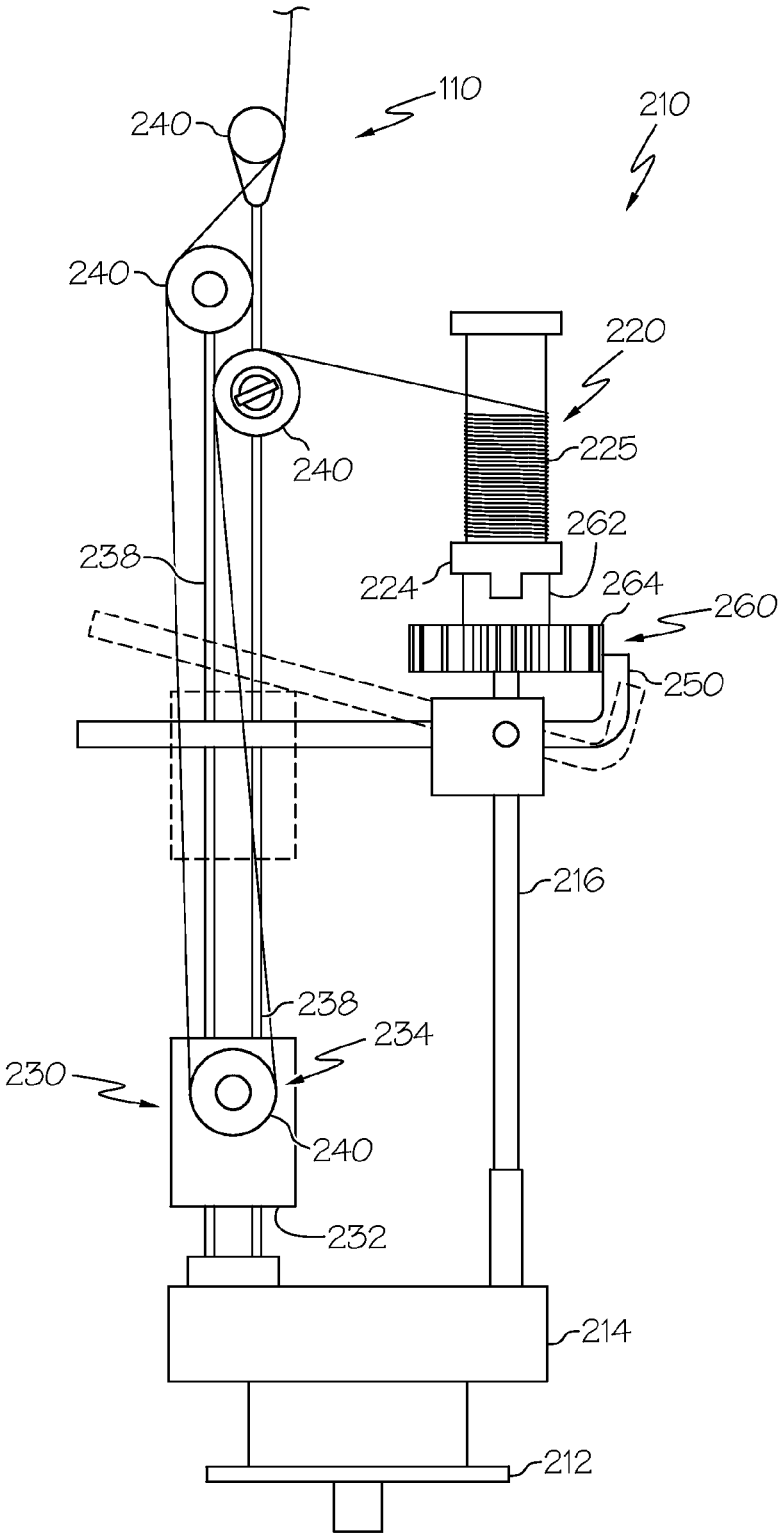
FIG. 9 is a side view of a carrier for a braiding machine for manufacturing thread according to one or more embodiments shown and described herein.
Figure 10:
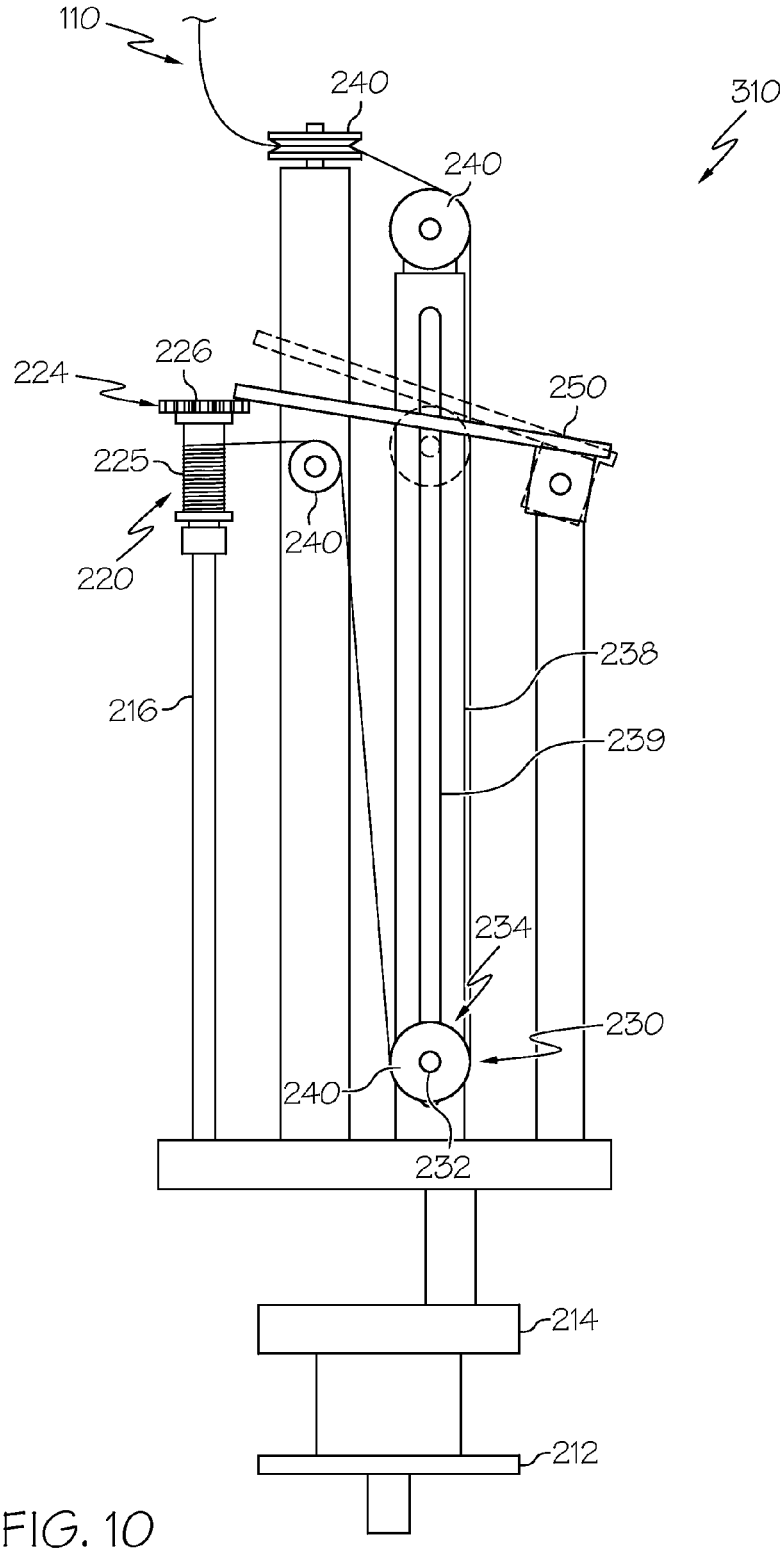
FIG. 10 is a side view of a carrier for a braiding machine for manufacturing thread according to one or more embodiments shown and described herein.
Figure 11:
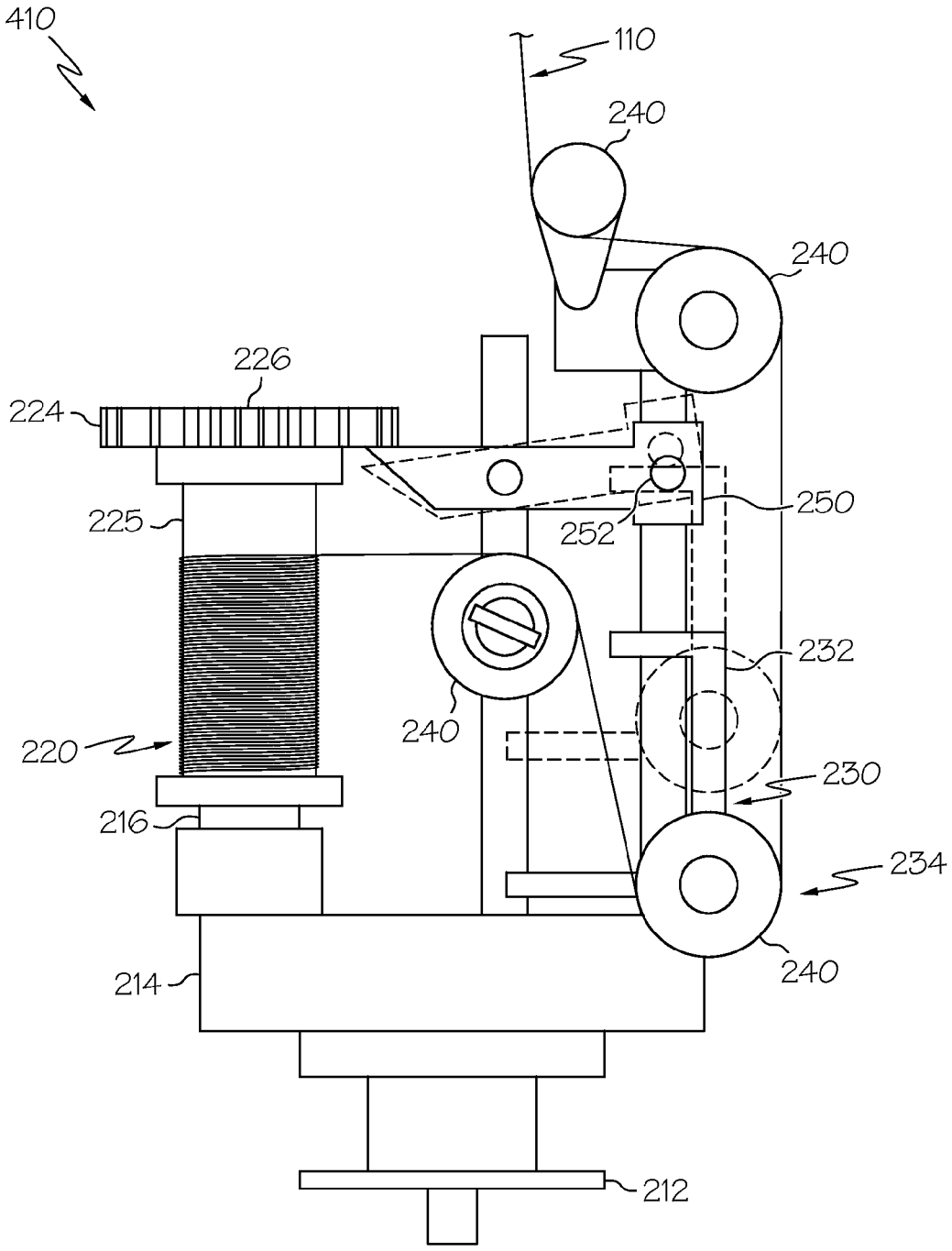
FIG. 11 is a side view of a carrier for a braiding machine for manufacturing thread according to one or more embodiments shown and described herein.

Referring now to FIGS. 9-11, three embodiments of low-tension carriers 210, 310, and 410 are depicted. The low-tension carriers 210, 310, 410 include a base member 214 that includes a braiding machine interface 212. The braiding machine interface 212 is inserted into the embedded track 203 of the braiding machine 200 (see FIG. 8). The low-tension carriers 210, 310, 410 follow the path of the embedded track 203 to pay out the CNT filament 110 in the desired braiding pattern.

The low-tension carriers 210, 310, 410 include a spindle 216 that is coupled to the base member 214 and extends away from the braiding machine interface 212. A bobbin 220 comprises a pay-out spool 225 and an indexing interface 224. The bobbin 220 is mounted on the spindle 216. The low-tension carrier 210 also includes a pawl 250 that is coupled to the base member 214. The pawl 250 is configured to move between a plurality of positions include an engagement position where the pawl 250 is biased to engage the indexing interface 224 of the bobbin 220. While in the engagement position, the pawl 250 resists rotation of the bobbin 220. The pawl 250 may also be positioned in a disengaged position where the pawl 250 is disengaged from the indexing interface 224 of the bobbin 220, thereby allowing the bobbin 220 to rotate.

The low-tension carriers 210, 310, 410 further include a tensioner guide post 238 that is coupled to the base member 214 and extends away from the braiding machine interface 212. The tensioner guide post 238 is positioned in a generally vertical orientation. A tensioner assembly 230 includes a tensioner bracket 232 and a guide roller 234. The tensioner bracket 232 slides along the tensioner guide post 238 through a plurality of positions including a non-contacting position where the tensioner bracket 232 is spaced apart from the pawl 250, thereby allowing the pawl 250 to be positioned in the engaged position with the indexing interface 224 of the bobbin 220. The tensioner bracket 232 may also be positioned in a contacting position where the tensioner bracket is in contact with the pawl 250, thereby placing the pawl 250 into the disengaged position from the indexing interface 224 of the bobbin 220. The CNT filament 110 is wound at least partially around the guide roller 234. Actuation tension applied to the guide roller 234 by the CNT filament 110 causes the tensioner bracket 232 to translate towards the contacting position.

CNT filament 110 is wound onto the pay-out spool 225 of the bobbin 220. The CNT filament 110 follows a stringing path along the low-tension carriers 210, 310, 410. The stringing path directs the CNT filament 110 from the bobbin 220 through a plurality of shiv wheels 240 into the desired orientation. The shiv wheels 240 are low-friction guide wheels that further reduce the tension required to be applied to the CNT filament 110 in the braiding operation. The CNT filament 110 passes below the guide roller 234 of the tensioner assembly 230, where the guide roller 234 is a shiv wheel 240.

As the low-tension carriers 210, 310, 410 follow the embedded track 203 of the braiding machine 200, the effective length of the CNT filament 110 changes. To accommodate the change in effective length of the CNT filament 110, the tensioner bracket 232 traverses upwards and downwards along the tensioner guide post 238, applying a force to the CNT filament 110 with the guide roller 234. As the braiding operation progresses, the effective length of the CNT filament decreases, which causes the tensioner bracket 232 to translate towards and contact the pawl 250. When the tensioner bracket 232 contacts the pawl 250, the tensioner bracket 232 is in the contacting position and the pawl 250 is placed into the disengaged position from the indexing interface 224 of the bobbin 220. The tension applied to the CNT filament 110 by the tensioner bracket 232 causes the bobbin 220 to rotate, paying out CNT filament 110 from the pay-out spool 225. CNT filament 110 is paid out until the tensioner bracket 232 slides away from the pawl 250, thereby allowing the pawl 250 to be positioned in the engaged position with the indexing interface 224, thereby resisting rotation of the pay-out spool 225.

For the embodiments depicted in FIGS. 9-11, the tension that is applied to the CNT filament 110 to perform the braiding operation is controlled by the friction applied by the shiv wheels 240 to the CNT filament 110 and by the weight of the tensioner assembly 230. In some embodiments, an actuation tension of less than 20 grams-force, for example, from about 10 grams-force to about 20 grams-force, is sufficient to translate the tensioner assembly 230 to the contact position, move the pawl 250 to the disengaged position, and pay out CNT filament 110 from the bobbin 220. If more tension is desired during a braiding operation, dropweight ballast (not shown) can be added to the tensioner bracket 232 to increases the weight of the tensioner assembly.

Referring now to FIG. 9, this embodiment of the low-tension carrier 210 includes a pay-out assembly 260 having a plurality of gear teeth 264 and a spindle interface 262 that is coupled to the indexing interface 224 of the bobbin 220. The spindle interface 262 controls rotation of the bobbin 220 relative to the rotation of the pay-out assembly 260. In the embodiment depicted in FIG. 9, the pawl 250 is a lever arm that pivots about the spindle 216. When the pawl 250 is in the engaged position, the pawl 250 contacts the gear teeth 264 of the pay-out assembly 260, thereby preventing rotation of the bobbin 220. As the tensioner bracket 232 is translated towards the contacting position with the pawl 250, the tensioner bracket 232 pivots the pawl 250 such that the pawl 250 is biased downwards away from the gear teeth 264 into the disengaged position. In the disengaged position, the pawl 250 is spaced apart from the gear teeth 264. With the pawl 250 spaced apart from the gear teeth 264, the pay-out assembly 260 and the bobbin 220 are free to rotate such that CNT filament 110 is paid out from the pay-out spool 225 of the bobbin 220.

Referring now to FIG. 10, this embodiment of the low-tension carrier 310 includes a bobbin 220 having a pay-out spool 225 and gear teeth 226, where the gear teeth 226 act as the indexing interface 224. The pawl 250 is a low-mass member that, when positioned in the engaged position, is biased by gravity to contact the gear teeth 226 of the pay-out spool. The tensioner assembly 230 is positioned such that the tensioner bracket 232 rides along a slot 239 positioned in the tensioner guide post 238. The CNT filament 110 follows the stringing path such that as the effective length of the CNT filament 110 decreases, the tensioner assembly 230 is moved towards the contacting position. The tensioner bracket 232 contacts the pawl 250 and lifts the pawl 250 away from the gear teeth 226 of the bobbin 220, thereby placing the pawl 250 in the disengaged position relative to the bobbin 220.

Referring now to FIG. 11, the embodiment of the low-tension carrier 410 includes a bobbin 220 having a pay-out spool 225 and gear teeth 226, where the gear teeth 226 act as the indexing interface 224. The pawl 250 is a lever arm that pivots about a pawl support post 254. The pawl includes a contact post 252. The CNT filament 110 follows the stringing path such that as the effective length of the CNT filament 110 decreases, the tensioner assembly 230 is moved along the tensioner guide post 238 towards the pawl 250. As the tensioner assembly 230 approaches the contacting position, the tensioner bracket 232 contacts the contact post 252 and pivots the pawl 250 into the disengaged position from the indexing interface 224 of the bobbin 220. When the pawl 250 is positioned in the disengaged position, the pawl 250 is spaced apart from the gear teeth 226 of the indexing interface. With the pawl 250 positioned in the disengaged position, the bobbin 220 is free to rotate, allowing CNT filament 110 to be paid out for the braiding operation.

In each of the embodiments of the low-tension carriers 210, 310, 410 described hereinabove, the tension applied to the CNT filament 110 during a braiding operation is reduced as compared with conventional, spring-biased carriers. The reduction in tension applied to the CNT filament 110 may allow for thinner CNT filament 110 to be braided into a thread 100. The use of thinner CNT filament 110 may allow for an increased number of CNT filaments 110 to be braided into a thread 100, thereby increasing the number of intersections 102 between CNT filaments 110 in the thread 100.

In one example, a thread 100 made of CNTs 106 was produced according to the techniques discussed herein. CNT filaments 110 were formed by being dry spun from an array 104, as discussed hereinabove. The individual CNTs 106 had an average diameter of about 10 nanometers and a length of about 220 microns. The CNTs 106 were drawn from the array 104 and pulled into a ribbon 105. The ribbon 105 was twisted about itself to form CNT filament 110 having an average diameter of about 20 microns. The tensile strength of the CNT filament 110 was measured using standard laboratory techniques. The tensile strength of the CNT filament 110 was determined to be about 0.6-0.8 GPa.

Four CNT filaments 110 were then wound onto bobbins, which were placed into a braiding machine. The CNT filaments 110 were braided into a 4-strand braided thread 100 in a 1-over, 1-under pattern at a pick frequency of about 20 picks per millimeter of thread 100. The individual CNTs 106 of the thread had about 8 intersections per CNT 106. After braiding, the thread 100 was tested to tensile overload using standard laboratory techniques. The tensile strength of the thread 100 was calculated as the breaking load of the thread 100 divided by the cumulative cross-sectional area of the four CNT filaments 110. The tensile strength of the thread 100 was determined to be greater than 5 GPa. Thus the tensile strength of the thread 100 is greater than the tensile strength of the constituent CNT filaments 110.

Thread 100 which has an increased tensile strength may be used in a variety of applications. For example, the thread 100 may be used in applications requiring tension members having a high strength. The thread 100 can be woven into a fabric to provide a high-strength fabric that can be molded and impregnated with resin to form a three-dimensional load-bearing component. The thread 100 can also be woven in combination with other materials including, but not limited to, aramids. A woven fabric such as this could be used as a ballistic reinforcement. Further, the thread 100 could be processed alone or together in combination with other materials to be braided into a high-strength rope.

In addition, thread 100 manufactured according to the methods disclosed herein incorporate the CNT properties of electrical conductivity and thermal conductivity. The thread 100 can be incorporated into a system that requires electrical or thermal conductivity while minimizing component weight. In one example, the thread 100 can be used as a light-weight, electrically conductive shielding jacket that is woven to surround electrical conductors.

It should now be understood that CNT filaments that are braided into a thread exhibit tensile strength properties that exceed the tensile strength properties of the CNT filaments themselves. The improvement in tensile strength properties is attributed to the frequency of intersections per length of the individual CNTs that are formed into the CNT filament. To increase the frequency of intersections in a thread, thinner CNT filaments may be braided with a high pick frequency. Further, to prevent breakage of the thinner CNT filaments in a machine braiding operation, low-tension carriers that pay out the CNT filaments may be used.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A braided carbon nanotube thread comprising at least three carbon nanotube filaments braided into a thread, wherein:

the carbon nanotube filaments are comprised of a plurality of carbon nanotubes, each of the carbon nanotubes having a length L; and the carbon nanotube filaments are braided such that the carbon nanotube thread has at least 8 intersections per the length L of each carbon nanotube and less than 20 intersections per the length L.

2. The braided carbon nanotube thread of claim 1, wherein the carbon nanotubes are twisted about one another to fortify the carbon nanotube filaments.

3. The braided carbon nanotube thread of claim 1, wherein the carbon nanotubes have a diameter of at least 10 nanometers, the length L of each carbon nanotube is at least 220 microns, and the carbon nanotube thread has at least 20 picks per millimeter.

4. The braided carbon nanotube thread of claim 1 further comprising a core section about which the carbon nanotube filaments are braided.

5. The braided carbon nanotube thread of claim 1, wherein a tensile strength of the braided carbon nanotube thread is greater than a tensile strength of the collective carbon nanotube filaments.

6. The braided carbon nanotube thread of claim 1, wherein a tensile strength of each of the carbon nanotube filaments is less than 1 GPa.

7. The braided carbon nanotube thread of claim 1, wherein a tensile strength of the braided carbon nanotube thread is greater than 5 GPa.

8. A braided carbon nanotube thread comprising at least three carbon nanotube filaments braided into a thread, wherein:

the carbon nanotube filaments are comprised of a plurality of carbon nanotubes each having a length of at least 220 microns and a diameter of at least 10 nanometers; and the carbon nanotube filaments are braided with at least 20 picks per millimeter of carbon nanotube thread.

9. The braided carbon nanotube thread of claim 8 further comprising a core section about which the carbon nanotube filaments are braided.

10. The braided carbon nanotube thread of claim 8, wherein a tensile strength of the braided carbon nanotube thread is greater than a tensile strength of the collective carbon nanotube filaments.

11. The braided carbon nanotube thread of claim 8, wherein a tensile strength of each of the carbon nanotube filaments is less than 1 GPa.

12. The braided carbon nanotube thread of claim 8, wherein a tensile strength of the braided carbon nanotube thread is greater than 5 GPa.

13. A low-tension carrier for supplying a carbon nanotube filament from a bobbin to a braiding machine, the low-tension carrier comprising:

a base member comprising a braiding machine interface;

a spindle coupled to the base member and extending away from the braiding machine interface;

a tensioner guide post coupled to the base member and extending away from the braiding machine interface;

the bobbin is mounted on the spindle for rotation about the spindle and the bobbin comprises a pay-out spool and an indexing interface;

a pawl coupled to the base member and having a plurality of positions including an engaged position wherein the pawl is biased to resist rotation of the indexing interface of the bobbin, and a disengaged position wherein the pawl is biased to allow rotation of the indexing interface of the bobbin;

a tensioner assembly comprising a tensioner bracket and a guide roller, the tensioner assembly having a plurality of positions as the tensioner bracket translates along the tensioner guide post, the positions including a non-contacting position wherein the tensioner bracket is spaced apart from the pawl thereby allowing the pawl to be positioned in the engaged position, and a contacting position wherein the tensioner bracket is in contact with the pawl thereby placing the pawl in the disengaged position, wherein the tensioner assembly applies an actuation tension to the carbon nanotube filament.

14. The low-tension carrier of claim 13, wherein the tensioner guide post is positioned in a generally vertical orientation.

15. The low-tension carrier of claim 13, wherein the guide roller of the tensioner assembly comprises a shiv wheel that directs the carbon nanotube filament as the carbon nanotube filament is paid out from the bobbin.

16. The low-tension carrier of claim 13 further comprising a shiv wheel coupled to the tensioner guide post.

17. The low-tension carrier of claim 13, wherein the actuation tension of the carbon nanotube filament that translates the tensioner assembly towards the pawl is less than 20 grams-force.

18. The low-tension carrier of claim 13, wherein the actuation tension of the carbon nanotube filament that translates the tensioner assembly towards the pawl is greater than 10 grams-force.

19. A method of producing a braided carbon nanotube thread comprising:

providing an array of aligned carbon nanotubes;

drawing a plurality of carbon nanotubes from the array thereby forming a carbon nanotube filament comprising the plurality of carbon nanotubes, wherein each of the carbon nanotubes has a length L;

twisting the plurality of drawn carbon nanotubes of the carbon nanotube filament about one another;

winding the carbon nanotube filament onto at least three bobbins;

installing the bobbins into respective low-tension carriers of a braiding machine; and braiding the carbon nanotube filaments from the bobbins into a braided carbon nanotube thread, wherein the braided carbon nanotube thread has at least 8 picks per the length L.

20. The method of claim 19, wherein:

the bobbins are installed into respective carriers of the braiding machine;

the bobbins comprise a pay-out spool and an indexing interface; and the low-tension carriers each comprise:

a base member comprising a braiding machine interface;

a spindle secured to the base member and extending away from the braiding machine interface;

a tensioner guide post secured to the base member and extending away from the braiding machine interface;

the bobbin is mounted on the spindle for rotation about the spindle;

a pawl coupled to the base member and having a plurality of positions including an engaged position wherein the pawl is biased to resist rotation of the indexing interface of the bobbin, and a disengaged position wherein the pawl is biased to allow rotation of the indexing interface of the bobbin; and a tensioner assembly comprising a tensioner bracket and a guide roller, the tensioner assembly having a plurality of positions as the tensioner bracket translates along the tensioner guide post, the positions including a non-contacting position wherein the tensioner bracket is spaced apart from the pawl thereby allowing the pawl to be positioned in the engaged position, and a contacting position wherein the tensioner bracket is in contact with the pawl thereby placing the pawl in the disengaged position, wherein the tensioner assembly applies an actuation tension to the carbon nanotube filament.

21. The method of claim 19, wherein braiding the carbon nanotube filaments from the at least three bobbins into a braided carbon nanotube thread comprises:

translating the low-tension carrier along an embedded track of the braiding machine;

paying out the carbon nanotube filaments from the bobbins; and intertwining the carbon nanotube filaments in a repeated pattern.

22. The method of claim 21 further comprising introducing a core section to the braiding machine, wherein the carbon nanotube filaments are braided around the core section.

23. The method of claim 20, wherein an actuation tension of the carbon nanotube filament that translates the tensioner assembly towards the pawl is less than 20 grams-force.

24. The method of claim 20, wherein an actuation tension of the carbon nanotube filament that translates the tensioner assembly towards the pawl is greater than 10 grams-force.

* * * * *